US007664416B2

(12) United States Patent
Watabe

(10) Patent No.: US 7,664,416 B2
(45) Date of Patent: Feb. 16, 2010

(54) IMAGE RECORDING APPARATUS INCLUDING A FUSING UNIT HAVING A PLURALITY OF HEATER MEMBERS

(75) Inventor: Tomonori Watabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 301 days.

(21) Appl. No.: 11/370,621

(22) Filed: Mar. 8, 2006

(65) Prior Publication Data

US 2006/0204266 A1 Sep. 14, 2006

(30) Foreign Application Priority Data

Mar. 10, 2005 (JP) ..... 2005-066842

(51) Int. Cl.
*G03G 15/20* (2006.01)

(52) U.S. Cl. ..... 399/69; 399/320; 399/328; 399/330; 399/334

(58) Field of Classification Search ..... 399/67, 399/69, 320, 328, 330, 334
See application file for complete search history.

(56) References Cited

U.S. PATENT DOCUMENTS 5,131,079 A * 7/1992 Miyawaki et al. ..... 345/418
5,402,211 A * 3/1995 Yoshikawa ..... 219/216
5,671,462 A * 9/1997 Toyohara et al. ..... 399/33
5,682,577 A * 10/1997 Kiyoi ..... 399/69
5,904,871 A * 5/1999 Sakai et al. ..... 219/216
6,301,454 B1 * 10/2001 Nishida et al. ..... 399/69
6,713,725 B2 * 3/2004 Izawa et al. ..... 219/216
2006/0000819 A1 * 1/2006 Makihira et al. ..... 219/216

FOREIGN PATENT DOCUMENTS

JP 2001-201978 A 7/2001

* cited by examiner

*Primary Examiner*—David M Gray
*Assistant Examiner*—Geoffrey T Evans
(74) *Attorney, Agent, or Firm*—Panitch Schwarze Belisario & Nadel LLP

(57) ABSTRACT

An image apparatus which minimizes temperature differences between end portions and a central portion of a print medium includes heater members having different heat distributions, a temperature detecting unit for detecting a temperature of an area where a print medium passes through, a heat controlling unit for controlling a fusing unit temperature by an individual heat controlling of the heater members based on the temperature detected by the temperature detecting unit, and a rate determination unit for determining a divisional rate of heat to be charged per unit time to the fusing unit by means of the heater members. The rate determination unit determines the divisional rate based on the fusing condition input and the heat controlling unit which controls the heater members individually on the basis of the divisional rate determined by the rate determination unit.

16 Claims, 14 Drawing Sheets

IMAGE RECORDING APPARATUS INCLUDING A FUSING UNIT HAVING A PLURALITY OF HEATER MEMBERS

BACKGROUND OF THE INVENTION

1. Field of the Invention

The present invention relates to an image recording apparatus which applies heat and pressure to a predetermined print medium to heat fuse a toner image onto the print medium.

2. Description of Related Art

Conventionally, an electrophotographic recording type image recording apparatus for forming an image by heat fusing a toner image onto a predetermined print medium has been known. Such an image recording apparatus includes processes of charging and exposing a photo conductor, developing an electrostatic latent image formed on the photo conductor by a toner, transferring of thus obtained toner image onto the print medium and fusing the toner image onto the print medium, resulting in a formation of an image.

In this type of image recording apparatus, a constant control of a temperature of a fusing roller when a printing paper as the print medium passes therethrough improves a prevention of a fusing nonuniformity. However, in this type of image recording apparatus, a temperature of an area of the fusing roller where the printing paper does not pass therethrough becomes higher than a temperature of an area of the fusing roller where the printing paper passes therethrough in a case where a width of the printing paper is shorter than a width of the fusing roller, resulting in the fusing nonuniformity at end portions of the printing paper.

To resolve the above problems, techniques to prevent such fusing nonuniformity have been proposed (for example, see Japanese Patent Laying-Open Publication No. 2001-20978).

Specifically, Japanese Patent Laying-Open Publication No. 2001-201978 discloses a fusing device including a fusing roller, a heating roller having a heat source therein, an endless fusing belt stretched between these rollers, a pressurizing roller disposed opposing to the fusing roller through the belt, in which a toner image on the printing paper is conveyed to a space between the pressurizing roller and the fusing belt to achieve fusing of the toner image. More specifically, the fusing device includes a first heater having a heat distribution corresponding to a width of a small sized printing paper and a second heater having a heat distribution corresponding to both end portions other than the heat distribution of the first heater, in which only the first heater is used when a size of the printing paper is small whereas the first and second heaters are used when the size of the printing paper is large, namely, a use of the heaters having individual heat distribution is switched over according to the sizes of the printing papers.

However, in the conventional fusing device as stated in the above Japanese Patent Laying-Open Publication No. 2001-201978, if fusing is attempted to be performed onto printing papers of various widths such as a range of sizes of A5 lengthwise size to A3 lengthwise extended size, only a switching of a use of two heaters between a large size and a small size often raises a problem of an occurrence of the fusing nonuniformity, since there occurs a large temperature difference between temperatures of end portions of the printing paper and a temperature of a center portion of the printing paper in terms of the printing papers belonging to a range of middle width of between a maximum width and a minimum width such as A4 lengthwise size and B4 lengthwise size, thereby inducing an occurrence of the fusing nonuniformity.

Also, in the conventional fusing device, there is the temperature difference between the end portions and the central portion of the printing paper due to a thickness of the printing paper and/or a conveyance speed of the printing paper upon fusing even in the case of the printing paper of the same size. If the temperature difference becomes large, there arises a problem that the fusing nonuniformity still occurs.

The present invention was made in consideration of the above stated current condition. The present invention aims to provide an image recording apparatus capable of minimizing the temperature difference caused by differences of conditions such as a size and/or a conveyance speed between the end portions and the central portion of the printing paper in order to prevent the fusing nonuniformity, resulting in achieving a good printing quality.

SUMMARY OF THE INVENTION

The image recording apparatus according to the present invention for achieving the above stated purpose includes a fusing unit for heat fusing a toner image onto a predetermine print medium subsequent to heating and pressuring of the print medium, the image recording apparatus further including a plural heater members having different heat distributions disposed in the fusing unit in order to heat the print medium; a temperature detecting unit for detecting a temperature of an area of the fusing unit where the print medium passes through; a heat controlling unit for controlling the temperature of the fusing unit at a prescribed temperature by heat controlling the plural heater members independently on the basis of the temperature detected by the temperature detecting unit; a rate determination unit for determining a divisional rate of heat amount to be charged per unit time with regard to the fusing unit by means of the plural heater members; and a condition input unit for inputting fusing conditions of the fusing unit, in which the rate determination unit determines the divisional rate of the heat amount to be charged per unit time for the fusing unit by means of the plural heater members on the basis of the fusing conditions input through the condition input unit and in which the heat controlling unit heat controls the plural heater members independently on the basis of the divisional rate determined by the rate determination unit.

With such an image recording apparatus according to the present invention, the divisional rate for dividing the heat amount by the plural heater members having different heat distributions per unit time can be variably set according to the fusing conditions. Therefore, the temperature difference caused by the difference of the fusing conditions between the end portions and the central portion of the print medium can be minimized, thereby being capable of preventing the fusing nonuniformity.

The image recording apparatus according to the present invention for achieving the above stated purpose includes a fusing unit for heat fusing a toner image onto a predetermine print medium subsequent to heating and pressuring of the print medium, the image recording apparatus further including a plural heater members having different heat distributions disposed in the fusing unit in order to heat the print medium; a first temperature detecting unit for detecting a temperature of an area of the fusing unit where the print medium passes through; a second temperature detecting unit for detecting temperatures of an end portion of the area where the print medium passes through, a heat controlling unit for controlling the temperature of the fusing unit at a prescribed temperature by heat controlling the plural heater members independently on the basis of a temperature detected by each of the first temperature detecting unit and the second temperature detecting unit; and a rate determination unit for determining a divisional rate of heat amount to be charged per unit time to the fusing unit by means of the plural heater members, in which the rate determination unit determines the divisional rate of the heat amount to be charged per unit time to the fusing unit by means of the plural heater members on the basis of a temperature difference between a temperature detected by the first temperature detecting unit and a temperature detected by the second temperature detecting unit and in which the heat controlling unit heat controls the plural heater members independently on the basis of the divisional rate determined by the rate determination unit.

With such an image recording apparatus according to the present invention, the divisional rate for dividing the heat amount charged per unit time by means of the plural heater members having different heat distribution can be set variably according to the temperature difference of the areas where the print medium passes through, such that the temperature difference occurring between the end portions and the central portion of the print medium can be minimized, resulting in prevention of the fusing nonuniformity.

Since the image recording apparatus according to the present invention detects the fusing conditions based on the temperature difference of the areas where the print medium passes through, a user still can select the heat distribution suitable for the print medium to be used even if the fusing conditions the user designated differ from the print medium actually stacked in the image recording apparatus. Therefore, the fusing nonuniformity caused by the user's erroneous designation can also be prevented.

The present invention achieves to minimize the temperature difference between the end portions and the central portion of the print medium caused by the difference of the fusing conditions, to prevent the fusing nonuniformity due to the temperature difference, and to enhance the printing quality.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein;

FIG. 2(*b*) is a cross sectional view illustrating the structure of the printer as the first embodiment of the present invention when viewing from upstream of a conveying direction of printing papers;

FIG. 4(*b*) is a graph showing heat distribution in an axis direction of a fusing roller of the printer as the first embodiment of the present invention, in which the heat distribution of the other one of two heater members is shown;

FIG. 7(*b*) illustrates wave forms of current signals for heater members of the printer as the first embodiment of the present invention, in which the wave forms of the current signals when the divisional rate is H1:H2=0.6:0.4;

FIG. 7(*c*) illustrates wave forms of current signals for heater members of the printer as the first embodiment of the present invention, in which the wave forms of the current signals when the divisional rate is H1:H2=0:1.0;

FIG. 11(*b*) is a graph showing a resultant heat distribution in the axis direction of the fusing roller of the printer as the first embodiment of the present invention, in which the divisional rate is H1:H2=0.6:0.4;

FIG. 11(*c*) is a graph showing a resultant heat distribution in the axis direction of the fusing roller of the printer as the first embodiment of the present invention, in which the divisional rate is H1:H2=1.0:0;

FIG. 12(*b*) is a graph showing a temperature distribution of the fusing roller of the printer as the first embodiment of the present invention, in which the divisional rate is H1:H2=0.6:0.4;

FIG. 12(*c*) is a graph showing a temperature distribution of the fusing roller of the printer as the first embodiment of the present invention, in which the divisional rate is H1:H2=1.0:0;

FIG. 16(*b*) is a lateral cross sectional view-illustrating another structure of the fusing unit of the printer as the embodiment of the present invention, in which a structure of the fusing unit both of two heater members are placed within the fusing roller is illustrated;

FIG. 16(*c*) is a lateral cross sectional view illustrating another structure of the fusing unit of the printer as the embodiment of the present invention, in which a structure of the fusing unit two heater members are placed in the fusing roller and the heating roller, respectively, is illustrated.

DETAILED DESCRIPTION OF THE INVENTION

Specific embodiments to which the present invention is applied are explained below into details referring to drawing.

The present embodiment exemplifies a printer as the image recording apparatus for heat fusing the toner image onto the predetermined print medium subsequent to heating and pressurizing the print medium. More specifically, the printer determines the divisional rate of the heat amount to be charged within the prescribed time period to the fusing section according to the fusing conditions and then heat controls those plural heater members independently on the basis of this divisional rate.

Explained here is the printer as the first embodiment.

Figure 1:
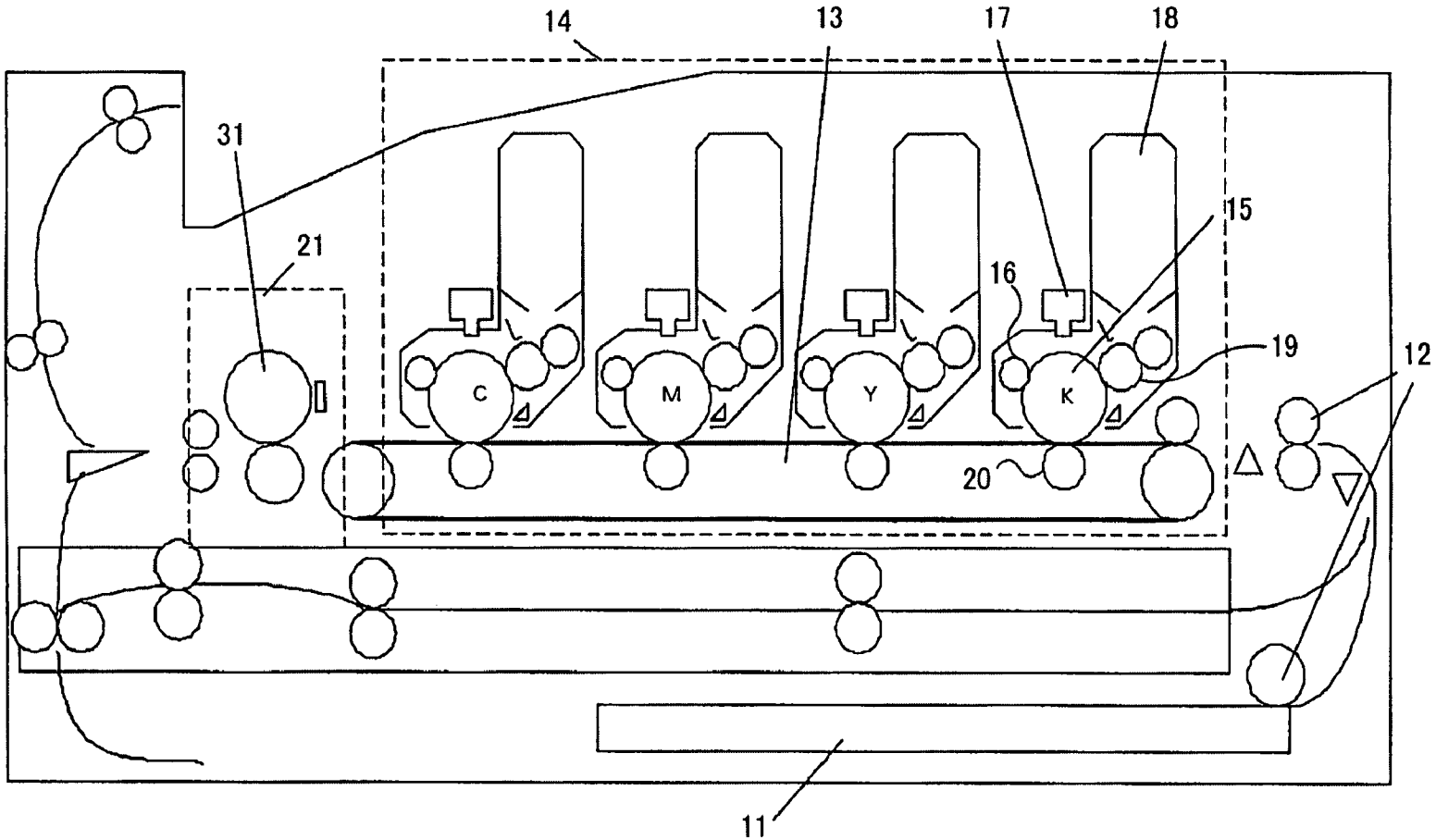
FIG. 1 is a lateral cross sectional view illustrating a structure of a printer as a first embodiment of the present invention.

FIG. 1 is a laterally cross sectional view illustrating a printer configuration. This printer has sheet stacker 11 for stacking printing papers as unprinted print media. The printing papers stacked in sheet stacker 11 is supplied from sheet stacker 11 in cooperation with a rotation of conveyer roller 12 disposed in a front portion of the printer to be conveyed to transfer belt 13 rotated by a motor, not shown, at a rotation speed suitable for printing speed.

Also, the printer has image printing section 14 in which four image printing units corresponding to four colors of black (K), yellow (Y), magenta (M) and cyan (C) are disposed in parallel in this order from a supplying side to a discharging side of the print media. Each image printing unit performs image formation onto the printing paper placed on transfer belt 13 using each color of toner. More specifically, the each of the image printing units includes photosensitive drum 15 carrying an electrostatic latent image, charging roller 16 for charging a surface of photosensitive drum 15, recording head 17 for exposing photosensitive drum 15 based on input image data, toner cartridge 18 for storing toner, developing roller 19 for developing the electrostatic latent image formed on photosensitive drum 15 using toner and transfer roller 20 for transferring thus produced toner image onto the printing paper.

Such image printing units form electrostatic latent images on photosensitive drum 15 and develop the electrostatic latent images using toner to form toner images. The toner images on photosensitive drums 15 developed by these image printing units are transferred onto the printing paper placed on transfer belt 13 by means of transfer roller 20. The printer sequentially forms an image of each color on the printing paper to finally form a color image composed of four colors in image printing section 14 having four image printing units of the above stated configuration.

The printer further has fusing unit 21 including fusing roller 31 downstream image printing section 14 as stated above. Fusing unit 21 applies heat and pressure onto the printing paper by fusing roller 31 to fuse the toner onto the printing paper, thereby achieving heat fusing of the toner image onto the printing paper. Then, the printer performs fusing of the image onto the printing paper in fusing unit 21, followed by conveying the printing paper in association with the rotation of the roller, discharging the printing paper outside the printer and placing the printing paper on the stacker.

Figure 2:
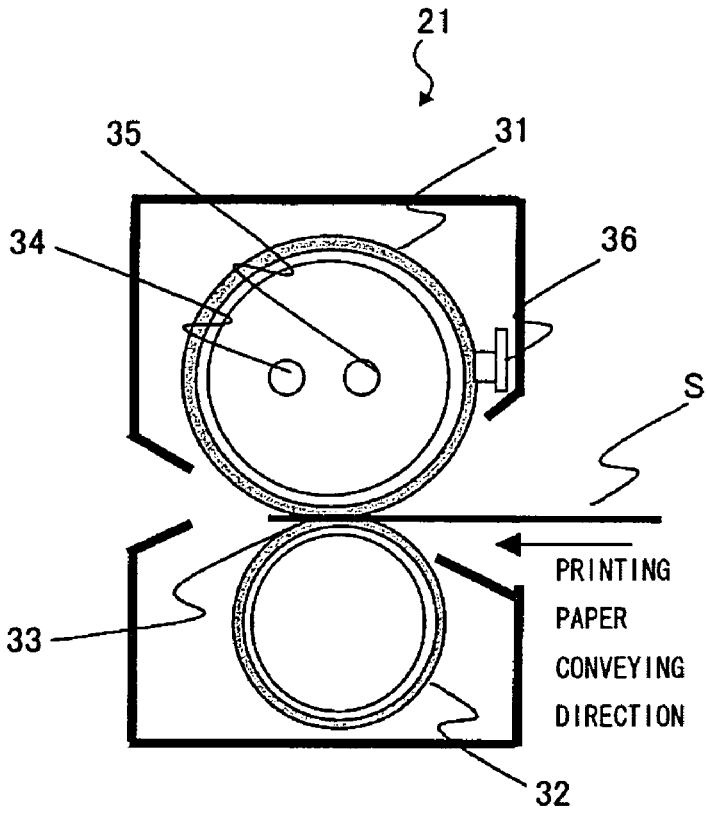
FIG. 2(*a*) is a lateral cross sectional view illustrating a structure of a fusing unit of the printer as the first embodiment of the present invention.
Figure 2:
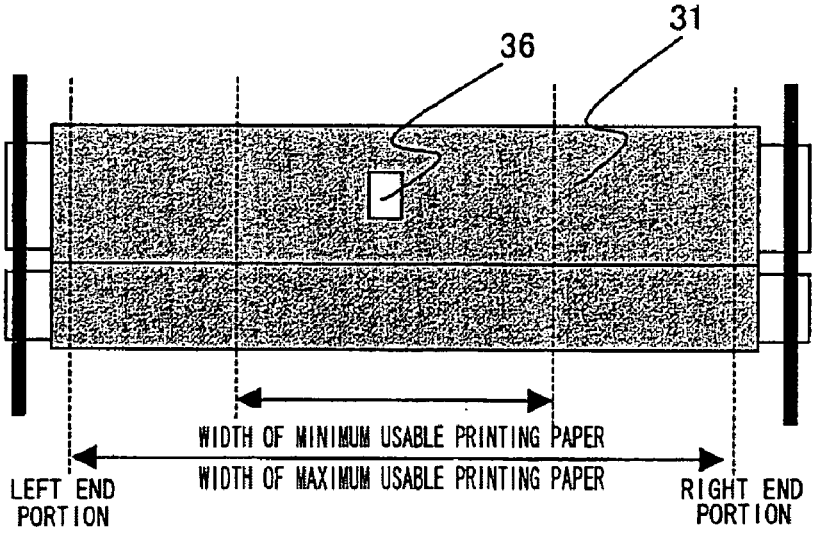

FIG. 2(*a*) is a laterally cross sectional view illustrating a structure of fusing unit 21. FIG. 2(*b*) is a cross sectional view illustrating a structure viewing fusing unit 21 from an upstream in a conveying direction of the printing paper.

Fusing unit 21 includes fusing roller 31 structured in such a way an outer periphery of a metal hollow roller is bonded with resilient member, and pressurizing roller 32 for pressurizing printing paper S together with fusing roller 31. Pressurizing roller 32 is disposed opposing to fusing roller 31 and brought into contact with the fusing roller in order to pressurize it, thereby providing nip portion 33 for clipping printing paper S. Such fusing unit 21, upon the rotations of fusing roller 31 and pressurizing roller 32, has printing paper S pass through nip portion 33 to apply heat to printing paper S in order to fuse the toner image thereonto.

Placed inside fusing roller 32 are two heater members 34, 35. Fusing unit 21, upon energizing heater members 34, 35, applies heat to fusing roller 31. Here, heater members 34, 35 are provided with current-carrying wires individually such that each of the heater members can have a different heat distribution and can be heated independently, as will be described later.

Temperature sensor 36 as a temperature detecting unit is brought into contact with a surface of fusing roller 31. In fusing unit 21, temperature sensor 36 detects a surface temperature of fusing roller 31 to control energization of heater members 34, 35 such that the detected temperature becomes equal to the targeted control temperature. Further, in fusing unit 21, a position where printing paper S passes through is defined in such a manner a center of fusing roller 31 in an axis direction as a reference position meets the central portion in a width direction of printing paper S and temperature sensor 36 is disposed such that the surface temperature of the central portion in the axis direction of fusing roller 31 is detected as the temperature of the area where the printing paper passes through.

Figure 3:
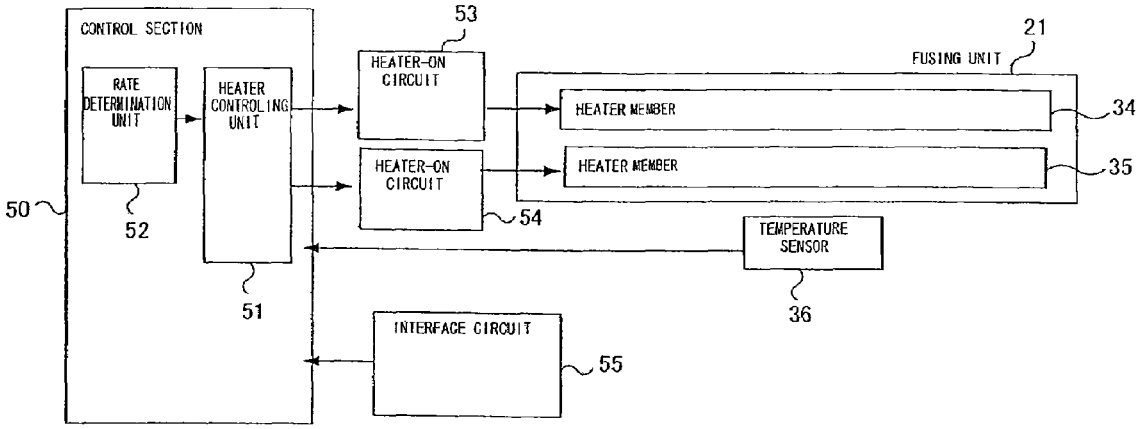
FIG. 3 is a block diagram illustrating a control system of the printer as the first embodiment of the present invention.

Fusing unit 21 as stated above performs heat controlling of heater members 34, 35 through a control system as shown in FIG. 3. In other words, the printer has control section 50 for controlling an operation of each of the units of the printer.

Control section 50 includes a CPU (Central Processing Unit) activated by a program stored in a memory element such as a ROM (Read Only Memory), not shown, in order to control the operation of each of the units of the printer. Control section 50 includes heater controlling unit 51 as the heat controlling unit for operating conducting period with regard to heater members 34, 35 in fusing unit 21 and rate determination unit 52 for determining the divisional rate for dividing the heat amount charged per unit time to fusing roller 31 between two heater members 34, 35. Being inputted detected temperature information indicative of the surface temperature of fusing roller 31 detected by temperature sensor 36 in fusing unit 21 and divisional rate information indicative of divisional rate determined by rate determination unit 52, heater controlling unit 51 generates conducting signals for heater members 34, 35 based on those information. The conducting signals output from heater controlling unit 51 for heater members 34, 35 are input to heater-on circuits 53, 54 for placing heater members 34, 35 in on-state, respectively. Heater-on circuits 53; 54 pass driving currents to heater members 34, 35 when the input conducting signals represent on-period, and thereby heat controls heater members 34, 35.

Control section 50 inputs information indicative of a printing mode and/or size and/or thickness of printing paper S to be used as fusing conditions through interface circuit 55 which conducts communication with a host apparatus such as a personal computer connected to an external system of the printer, followed by determination of a printing paper conveying speed and/or width and/or thickness of the printing paper in the above printing process on the basis of those information and notification to rate determination unit 52 of the information indicative of those printing paper conveying speed and/or width and/or thickness of the printing paper. Rate determination unit 52 determines the divisional rate for dividing the heat amount charged per unit time into two heater members 34, 35 for fusing roller 31 on the basis of the notified information indicative of the printing paper conveying speed and/or the width and/or the thickness of the printing paper.

Figure 4:
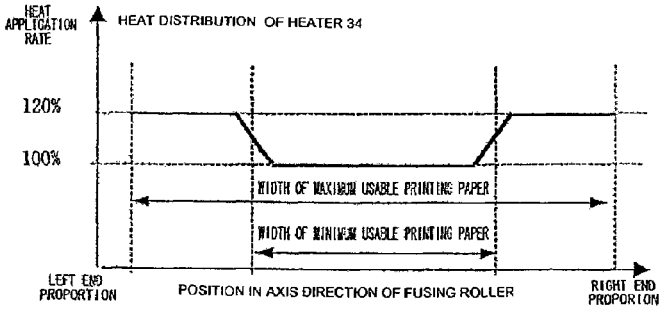
FIG. 4(*a*) is a graph showing heat distribution in an axis direction of a fusing roller of the printer as the first embodiment of the present invention, in which the heat distribution of one of two heater members is shown.
Figure 4:
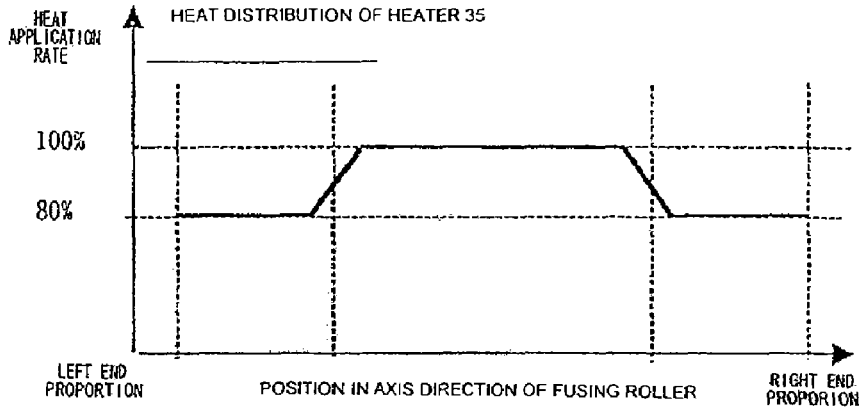

Fusing unit 21 heat controls heater members 34, 35 under such a control by control section 50. Here, the heat distributions of heater members 34, 35 in the axis direction of fusing roller 31 are exemplified in FIGS. 4(*a*) and 4(*b*), respectively. That is, assuming that the heat distribution in the axis direction of fusing roller 31 which equals to the width of a minimum sized printing paper usable by the printer is 100%, the heat distribution of heater member 34 is controlled in such a manner that the heat distribution of the both end portions in the axis direction of the printing paper other than the above assumed area becomes higher, i.e., at about 120%. On the other hand, the heat distribution of heater member 35, assuming that the heat distribution in the axis direction of fusing roller 31 which equals to the width of a minimum sized printing paper usable by the printer is 100%, the heat distribution of heater member 35 is controlled in such a manner that the heat distribution of the both end portions in the axis direction of the printing paper other than the above assumed area becomes lower, i.e., at about 80%. As such, the heat amount charged to the both end portions becomes large comparing to that of the central portion in the axis direction of fusing roller 31 in heater member 34, whereas the heat amount charged to the central portion in the axis direction becomes large comparing to that of the both end portions of fusing roller 31 in heater member 35.

Figure 17:
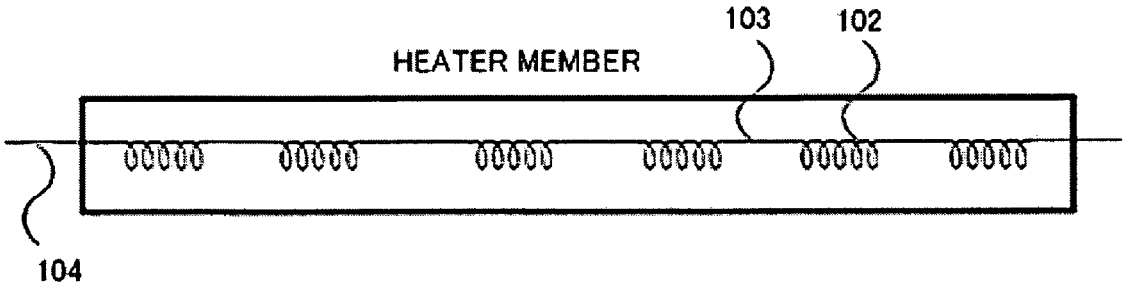
FIG. 17 is a cross sectional view of the heater member, in which a coil is disposed therewithin.

In the meanwhile, with respect to the current carrying wire 104 inside the heater member shown in FIG. 17, the heat distribution of the heater members 34, 35 can be varied upon changing the number of winds of a coil inside a coil member 102. That is, with respect to the heater member 34, such heat as distributed to both end portions in the axis direction can be increased upon setting the number of winds of the coil per unit length at the both end portions in the axis direction larger than that of the coil per unit length at the central portion in the axis direction. On the other hand, with respect to the heater number 35, such heat as distributed to both end portions in the axis direction can be decreased upon setting the number of winds of the coil per unit length at the both end portions in the axis direction less than that of the coil per unit length at the central portion in the axis direction. In addition, on the condition that the number of winds of the coil is set to the same between the both end portions and the central portion, the heat distribution can be increased upon setting a length of the coil member 102 longer than that of a non-coil member 103 per unit length or can be decreased upon setting a length of the coil member 102 shorter than that of the non-coil member 103 per unit length.

In the present embodiment, used are heating members 34, 35 having equal maximum tolerant rating heat losses (wattage) per unit length of the central portion in the axis direction of fusing roller 31 (minimum width of the usable printing paper). The maximum tolerant rating heat loss (wattage) means a maximum rating output of the heat amount of the heaters. Heat values of heater members 34, 35 in the minimum width of the usable printing paper become equal to each other. Fusing unit 21 may include, without being limited to those according to the present embodiment, heater members 34, 35 each having different maximum tolerant rating heat loss (wattage) per unit length of the central portion in the axis direction of fusing roller 31 (minimum width of the usable printing paper).

In the printer having the above stated fusing unit 21, the following operations are performed under the control of control section 50

Explained firstly is a constant temperature controlling operation of fusing roller 31.

Figure 5:
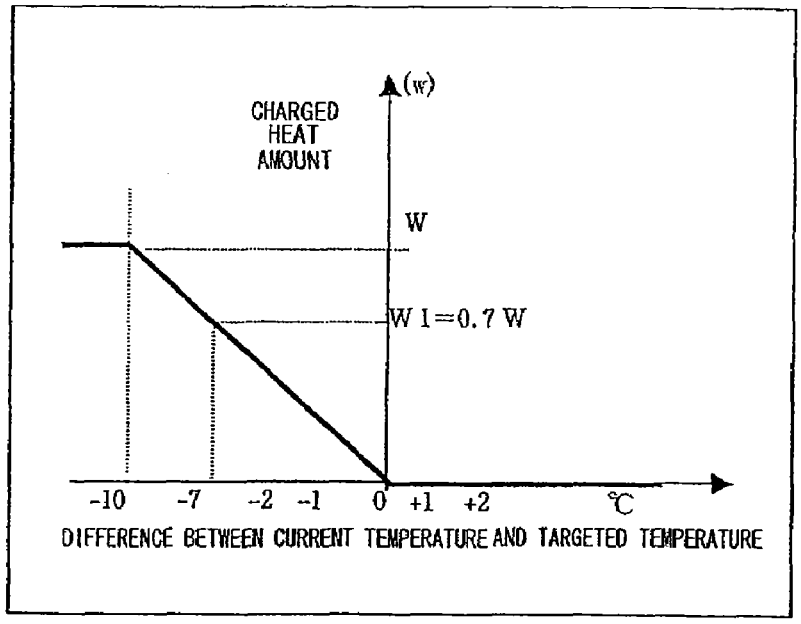
FIG. 5 is a graph showing a relationship between a temperature of the fusing roller and charged heat amount of the printer as the first embodiment of the present invention.

Firstly, heater controlling unit 51 calculates a difference between a current surface temperature of fusing roller 31 detected by temperature sensor 36 and a targeted preset temperature, and determines the heat amount per unit time to be charged to each of heater members 34, 35 on the basis of thus calculated temperature difference. More specifically, heater controlling unit 51 determines the heat amount per unit time to be charged to heater members 34, 35 on the basis, for example, of a graph representing a preset relationship as shown in FIG. 5. In FIG. 5, W represents the wattage of heater members 34, 35.

Figure 6:
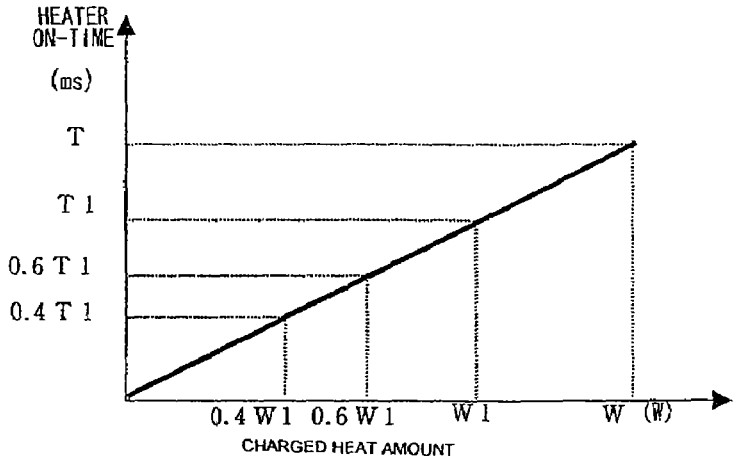
FIG. 6 is a graph showing a relationship between the charged heat amount and on-time of the heater members of the printer as the first embodiment of the present invention.

Secondly, heater controlling unit 51 calculates a sum of on-time where both of heater members 34, 35 are on-states based on the determined heat amount charged per unit time. That is, heater controlling unit 51 determines the sum of on-time where both of heater members 34, 35 are on-states based, for example, on the graph representing the preset relationship as shown in FIG. 6.

Heater controlling unit 51 assigns weights to thus detected summed value of the on-states of heater members 34, 35 with divisional rates H1, H2 (=1−H1) of the heat amount charged to heater members 34, 35 determined by rated determination unit 52, thereby determining the on-time of heater members 34, 35, respectively. More specifically, provided that the heat amount charged per unit time is determined as being W1 where divisional rates H1, H2 of the heat amount charged to heater members 34, 35 are H1:H2=0.6:0.4, respectively, as shown in FIG. 6, heater controlling unit 51 determines the on-time of heater member 34 as being 0.6×T1 and the on-time of heater member 35 is determined as being 0.4×T1, respectively, where the summed value of the on-time with regard to charged heat amount W1 is T1.

Figure 7:
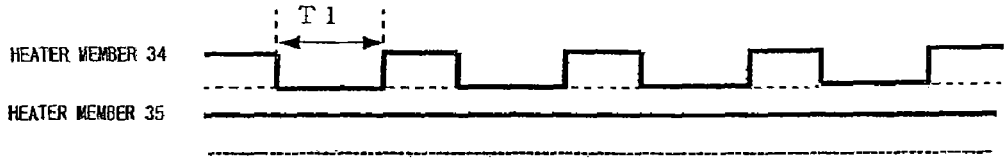
FIG. 7(*a*) illustrates wave forms of current signals for heater members of the printer as the first embodiment of the present invention, in which the wave forms of the current signals when the divisional rate is H1:H2=1.0:0.
Figure 7:
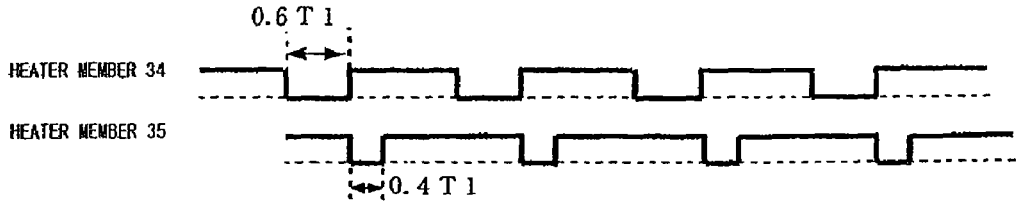
Figure 7:
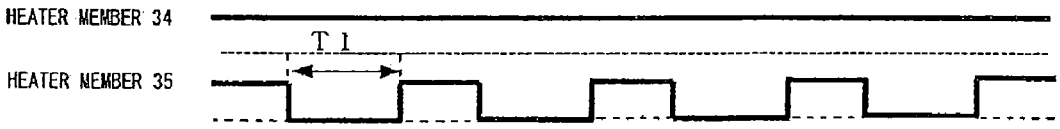

Heater controlling unit 51 generates a current signal, as exemplified in FIGS. 7(*a*) and 7(*c*), with regard to heater members 34, 35 on the basis of thus determined on-time of each of heater members 34, 35. Namely, heater controlling unit 51 generates the current signal composed of binary level signals to control heater-on circuit a 53, 54, respectively, in such a manner that heater members 34, 35 are energized with driving current only while a period the current signal is in low-level. FIG. 7(*a*) shows the current signal in a case where H1:H2=1.0:0, and thus heater controlling unit 51 controls heater-on circuit 53 so as to apply the driving current for a period of T1 by a predetermined cycle with regard to heater member 34 and heater-on circuit 54 so as not to apply the driving current with regard to heater member 35 as well. FIG. 7(*b*) shows the current signal in a case where H1:H2=0.6:0.4, and thus heater controlling unit 51 controls heater-on circuit 53 so as to apply the driving current for a period of 0.6×T1 by the predetermined cycle with regard to heater member 34 and heater-on circuit 54 so as to apply the driving current for a period of 0.4×T1 by the predetermined cycle with regard to heater member 35 as well. FIG. 7(*c*) shows the current signal in a case where H1:H2=0:1.0, and thus heater controlling unit 51 controls heater-on circuit 53 so as not to apply the driving current with regard to heater member 34 and heater-on circuit 54 so as to apply the driving current for a period of T1 by the predetermined cycle with regard to heater member 35 as well.

In the meanwhile, used as the heater members 34, 35 in the present embodiment are such as having equal maximum tolerant rating heat losses (wattage) per unit length of the central portion in the axis direction of fusing roller 31 (minimum width of the usable printing paper). There is no timing that current signals for both of heater members 34, 35 becomes on-time concurrently. Therefore, the same amount of heat is applied at all times to the central portion in the axis direction of fusing roller 31 (minimum width of the usable printing paper) where one of the heater members 34, 35 is in on state.

In FIGS. 7(*a*), 7(*b*) and 7(*c*), it is so illustrated that there is no timing that current signals for both of heater members 34, 35 becomes on-time concurrently. However, since an average heat amount charged per unit time is constant, there may be the timing that the current signals for both of heater members 34, 35 becomes on-time concurrently.

The above stated printer calculates the heat amount charged per unit time required for making the temperature difference 0 between the current surface temperature of fusing roller 31 detected by temperature sensor 36 and the preset targeted temperature under the control of heater controlling unit 51, and assigns thus calculated heat amount charged per unit time as the weight to heater members 34, 35 according to divisional rates H1, H2. The printer, then, determines the on-time of each of heater members 34, 35 corresponding to the heat amount charged per unit having thus assigned weight to energize heater members 34, 35 for thus determined on-time. The printer repeats such operations every unit time to keep the targeted temperature of fusing roller 31 stable.

Explained next are determination operations of the divisional rates of heater members 34, 35.

Figure 8:
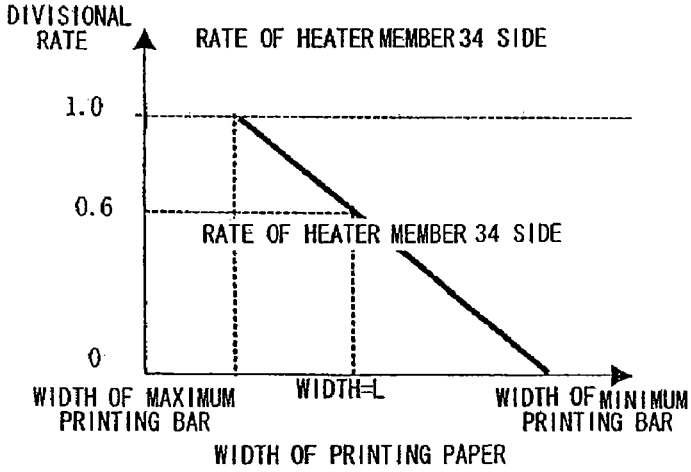
FIG. 8 is a graph showing a relationship between a width of the printing paper and the divisional rate of the printer as the first embodiment of the present invention.

Control section 50 determines the conveying speed and/or width and/or thickness of the printing paper in the printing operation based on the information indicative of the print mode and/or the size and/or the thickness of printing paper S input through interface circuit 55. In accordance therewith, rate determination unit 52 determines the divisional rates of heater members 34, 35, respectively, based on the information indicative of thus determined conveying speed and/or the width and/or the thickness of the printing paper. At the time, rate determination unit 52, for example as shown in FIG. 8, selects a divisional rate corresponding to thus input value of the width of the printing paper by previously setting a relational expression where the divisional rate with regard to the width of the printing paper is defined uniquely. Similarly, rate determination unit 52 previously defines the relational expression such that the divisional rate with regard to the thickness and/or conveying speed of the printing paper is defined uniquely as, for example, shown in FIGS. 9 and 10, and selects the divisional rate in accordance with the input value.

Figure 9:
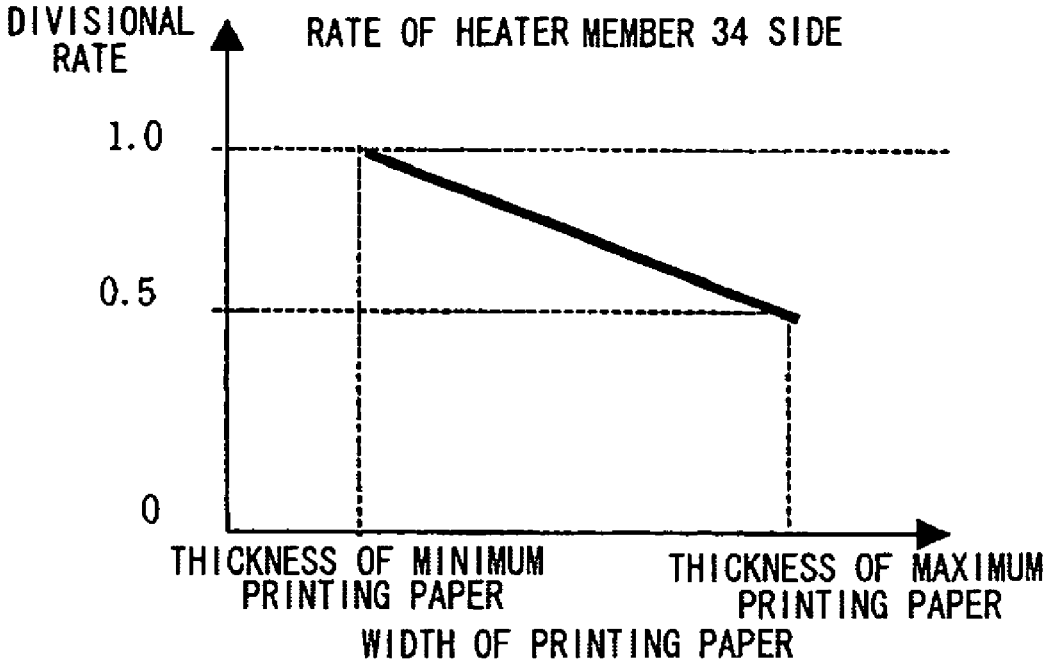
FIG. 9 is a graph showing a relationship between a thickness of the printing paper and the divisional rate of the printer as the first embodiment of the present invention.
Figure 10:
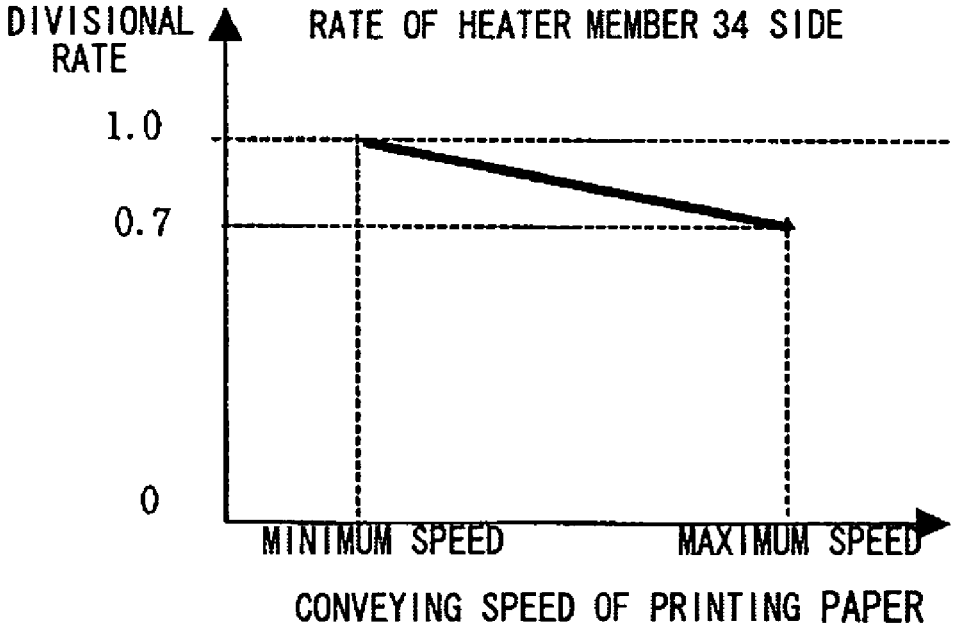
FIG. 10 is a graph showing a relationship between a conveying speed of the printing paper and the divisional rate of the printer as the first embodiment of the present invention.

FIGS. 9 and 10 show a relationship between the divisional rate and the thickness of the printing paper and between the divisional rate and the conveying speed of the printing paper, respectively.

As shown in FIG. 9, as the thickness of the printing paper becomes large, the divisional rate of the applied heat amount with respect to heater member 34 becomes low. In other words, the larger the thickness of the printing paper, the lower the heat rate applied to the both end portions in the axis direction of fusing roller 31. The reason thereof follows:

The heat amount the printing paper absorbs from fusing roller 31 per unit time becomes larger as the thickness of the printing paper becomes larger. Therefore, as the printing paper becomes thicker the surface temperature of fusing roller 31 is apt to decrease upon fusing. To keep the targeted temperature of fusing roller 31, the control section 51 increases the heat amount to be charged to fusing roller 31, i.e., the time period heater members 34, 35 are energized becomes longer. Here, the areas of fusing rollers 31 corresponding to the both end portions of the printing paper and outside the printing paper have a smaller decrease of the surface temperature of fusing roller 31 due to the heat absorption by the printing paper in comparison with the central portion in the axis direction of fusing roller 31. In the present embodiment, temperature sensor 36 detects both the temperature of the central portion in the axis direction of fusing roller 31. Therefore, when the control is performed on the basis of the temperature of the central portion in the axis direction of fusing roller 31, the heat amount at the both end portions of fusing roller 31 becomes excessive, resulting in a rise of the surface temperature. For the purpose of suppressing the rise of the temperature in the both end portions and keeping the surface temperature constant in the axis direction of fusing roller 31, the divisional rate of the applied heat amount with respect to heater member 34 is lowered as the thickness of the printing paper becomes thicker.

On the other hand, as shown in FIG. 10, the faster the conveying speed of the printing paper is, the lower the divisional rate of the applied heat amount with respect to heater member 34 becomes. In other words, as the conveying speed of the printing paper becomes faster, the rate of the applied heat amount in the axis direction of fusing roller 31 becomes lower. The reason thereof follows:

The heat amount the printing paper absorbs per unit time from fusing roller 31 becomes larger as the conveying speed of the printing paper becomes faster. Namely, as the conveying speed of the printing paper becomes faster, the surface temperature of fusing roller 31 is apt to decrease upon fusing the toner image onto the printing paper. Therefore, the control section 51 increases the heat amount to be charged to fusing roller 31 in order to keep the targeted temperature of fusing roller 31, i.e., the time period heater members 34, 35 are energized becomes longer. At the time, the areas of fusing roller 31 corresponding to both end portions of the printing paper and outside the printing paper have smaller temperature decreases in the surface of fusing roller 31 due to the heat absorption by the printing paper in comparison with that of the central portion in the axis direction of fusing roller 31. In the present embodiment, temperature censor 36 detects the temperature of the central portion in the axis direction of fusing roller 31. As such, when the control is performed on the basis of the temperature of the central portion in the axis direction of fusing roller 31, the heat amount of the both end portions of fusing roller 31 becomes excessive, resulting in a rise of the surface temperature. Consequently, to suppress the temperature rise of the both end portions and keep the surface temperature constant in the axis direction of fusing roller 31, the divisional rate of the applied heat amount with respect to heater member 34 is lowered as the conveying speed of the printing paper becomes faster.

Provided that the rate determined based on the width of the printing paper is H1, the rate determined based on the thickness of the printing paper is H1' and the rate determined based on the conveying speed of the printing paper is H1", rate determination unit 52 finds a product of those three rates H1, H1' and H1" (H1×H1×H1") as the divisional rate to be finally used. Rate determination unit 52 also can determine the divisional rate based only on the information indicative of the width of the printing paper without reflecting the information indicative of the thickness and the conveying speed of the printing paper. In such a case, the rate determination unit finds rate H1 determined based on the width of the printing paper as the divisional rate to be finally used.

To simplify the explanation of the determination operation of the divisional rate performed by rate determination unit 52, heat applications of heater members 34, 35 and the temperature distribution of fusing roller 31 when determining the divisional rate based only on the information indicative of the width of the printing paper will be explained. Explained here are three conditions such as a case where the width of printing paper S on which a toner image is fused equals to the width of the minimum printing paper usable by the printer, the width being in the axis direction of fusing roller 31, a case where the width of printing paper S on which a toner image is fused equals to the width of the maximum printing paper usable by the printer, the width being in the axis direction of fusing roller 31 and a case where the width of printing paper S on which a toner image is fused equals to the width L between the width of the minimum printing paper and the width of the maximum printing paper usable by the printer, the width being in the axis direction of fusing roller 31.

Control section 50 determines the width of printing paper S on which the toner image is fused on the basis of the information indicative of the size of printing paper S input through interface circuit 55. In accordance therewith, rate determination unit 52 determines the divisional rates of heater-members 34, 35 referring to a preset divisional rate as shown in FIG. 8 on the basis of the information indicative of the determined width of the printing paper. More specifically, if the width of printing paper S on which the toner image is fused equals to the width of the minimum printing paper, rate determination unit 52 determines the divisional rate as H1:H2=0:1.0. If the width of printing paper S on which the toner image is fused is width L between the width of the minimum printing paper and the width of the maximum printing paper, rate determination unit 52 determines the divisional rate as H1:H2=0.6:0.4. Further, if the width of printing paper on which the toner image is fused equals to the width of the maximum printing paper, rate determination unit 52 determines the divisional rate as H1:H2=1.0:0.

Figure 11:
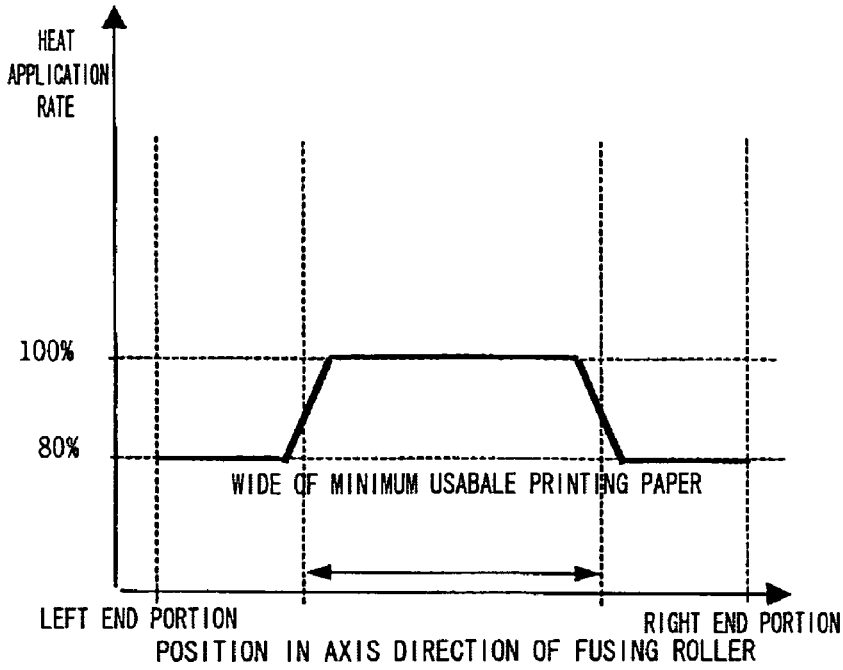
FIG. 11(*a*) is a graph showing a resultant heat distribution in the axis direction of fusing roller of the printer as the first embodiment of the present invention, in which the divisional rate is H1:H2=0:1.0.
Figure 11:
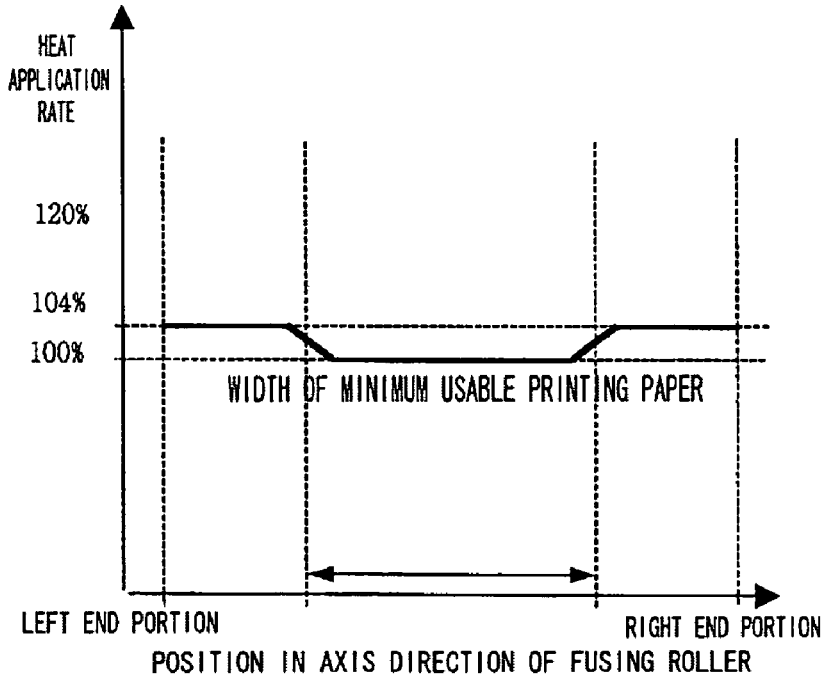
Figure 11:
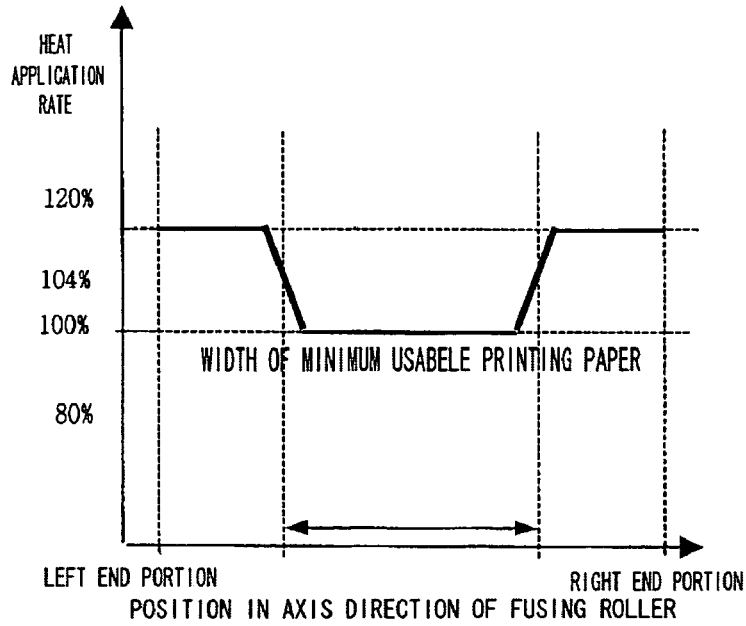

Here, a resultant heat distribution area in the axis direction of fusing roller 31 composed of the heat application from heater members 34, 35 with regard to each of the divisional rates is shown in FIGS. 11(*a*), 11(*b*) and 11(*c*). That is, the resultant charged heat distribution in the axis direction of fusing roller 31 becomes equal to the heat application from heater member 35 itself where the divisional rate is H1:H2=0:1.0, as shown in FIG. 11(*a*). The resultant heat distribution in the axis direction of fusing roller 31 becomes equal to the heat application from heater member 34 itself where the divisional rate is H1:H2=1.0:0, as shown in FIG. 11(*c*). Further, the resultant heat distribution in the axis direction of fusing roller 31 corresponds to a heat application in which the heat application from heater members 34, 35 are assigned by weights with the divisional rate of 0.6:0.4.

The sum of the heat amount charged from heater members 34, 35 to fusing roller 31 per unit length in the axis direction of fusing roller 31 can be found in the following expressions:

$$Wc=H1\times W1+H2\times W2 \text{ (central portion)}$$

$$Ws=H1\times a\times W1+H2\times b\times W2 \text{ (end portions).}$$

Here, W1 and W2 represent wattages per unit length of the central portion in the axis direction of fusing roller 31 with regard to heater members 34, 35; a represents the heat application rate of heater member 34 to the end positions with regard to the central portion in the axis direction of fusing roller 31; and b represents the heat application rate of heater member 35 to end portions with regard to the central portion in the axis direction of fusing roller 31 after composing the heat applications from heater members 34, 35 can be found by Ws/Wc. Namely, in a case where the wattages of the central portion in the axis direction of fusing roller 31 with regard to heater members 34, 35 are equal to each other (W1=W2), the heat application rate in the axis direction of fusing roller 31 can be found in the following expression, provided that H2=1-H1:

$$Ws/Wc=a\times H1+b\times H2=(a-b)\times H1+b$$

As stated above, the printer arbitrary determines the divisional rate H1 from any value between 0 and 1 under the control of rate determination unit 52, thereby being capable of setting a predetermined heat application rate to any value between the heat application rate of heater member 34 and the heat application rate of heater member 35. Also, even if a different wattage of the central portion in the axis direction of fusing roller 31 with regard to heater members 34, 35 is utilized by the printer, the printer still can select a plurality of heat application rate between the heat application rate of heater member 34 and the heat application rate of heater member 35.

Figure 12:
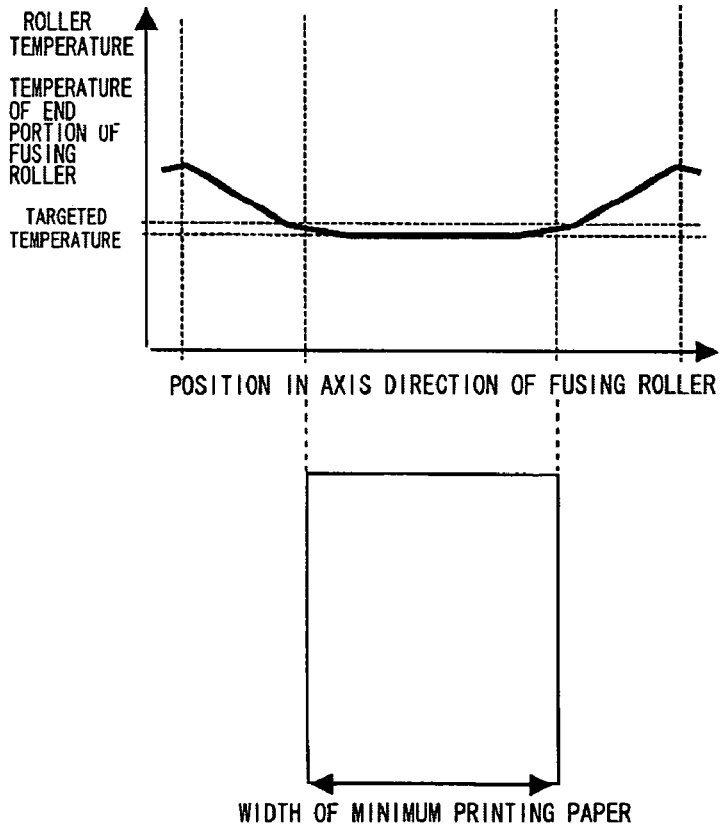
FIG. 12(*a*) is a graph showing a temperature distribution of the fusing roller of the printer as the first embodiment of the present invention, in which the divisional rate is H1:H2=0:1.0.
Figure 12:
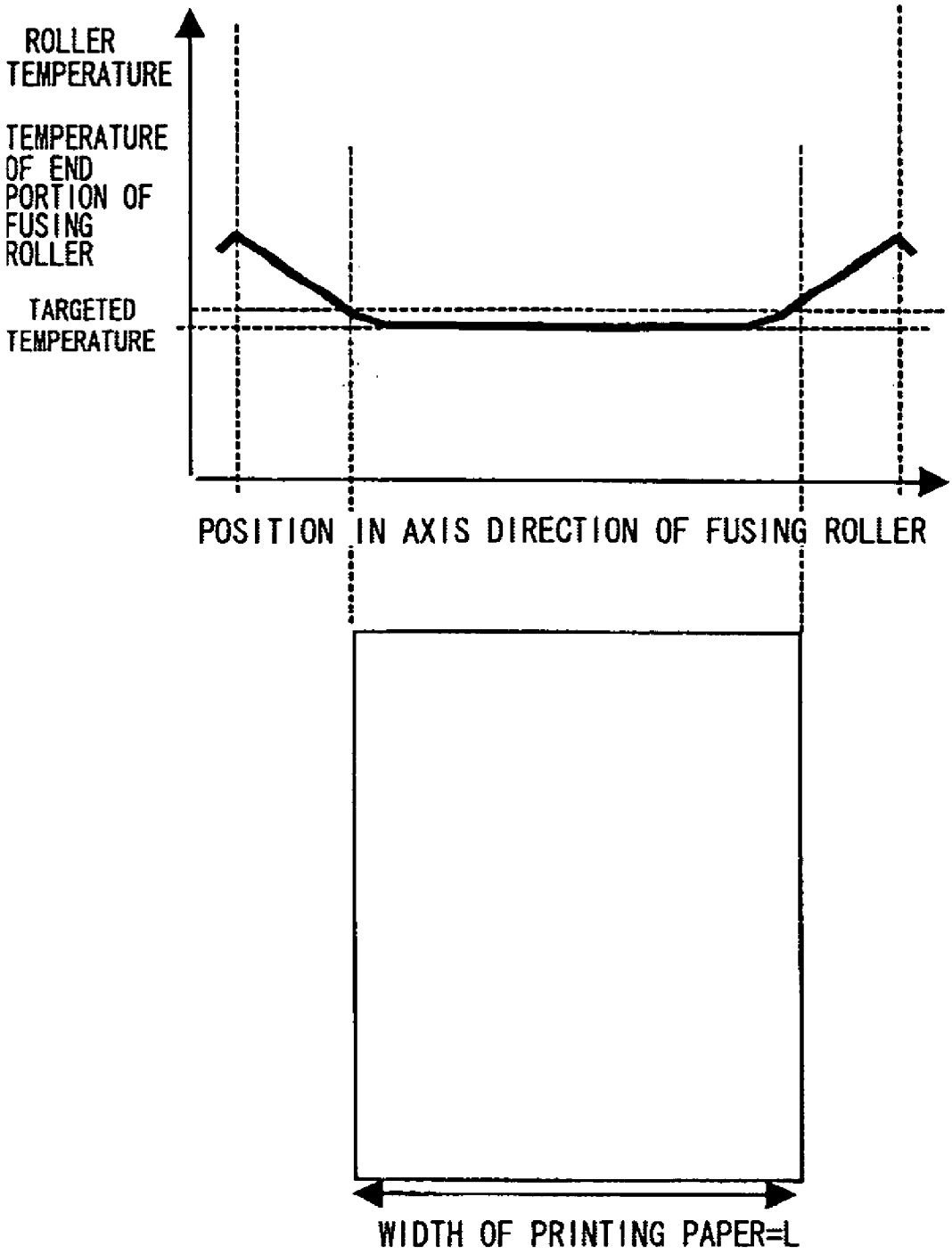
Figure 12:
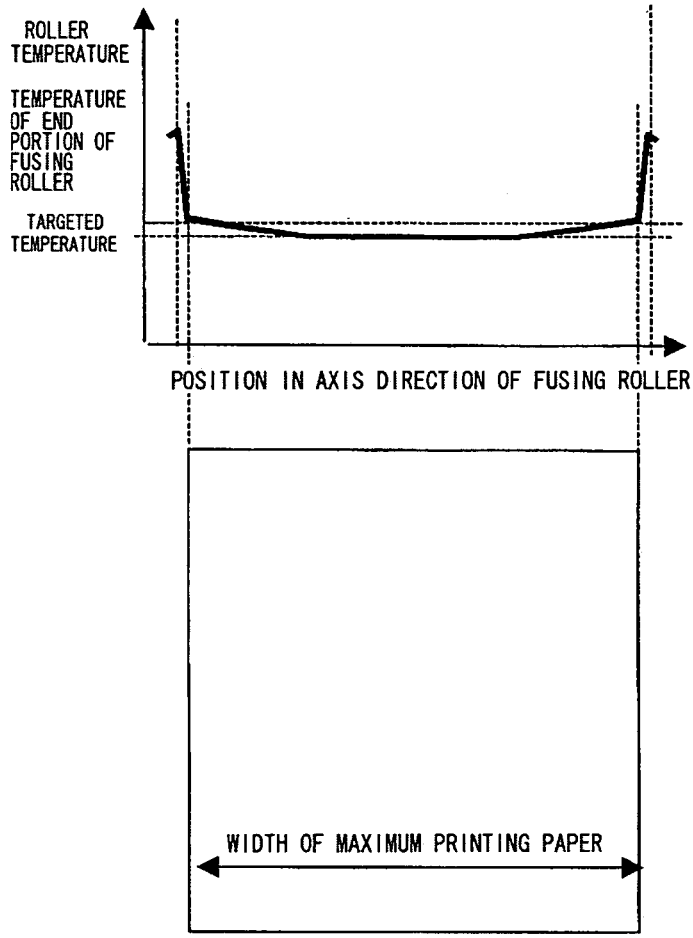

FIGS. 12(*a*), 12(*b*) and 12(*c*) show temperature distributions of fusing roller 31 when the divisional rate is determined with regard to each width of the printing papers and heater members 34, 35 are heat controlled.

In other words, if the width of printing paper S on which the toner image is fused equals to the width of the minimum printing paper, the resultant heat distribution in the axis direction of fusing roller 31 after composing heat applications from heater members 34, 35 is set lower in the end portions in the axis direction of fusing roller 31, the portions being the outside area where printing paper S passes through, than the central portion in the axis direction of fusing roller 31, as shown in FIG. 11(*a*) in the printer. Consequently, as to the temperature distribution of fusing roller 31 in fusing operation, the temperature rise outside the area where printing paper S passes through is suppressed as shown in FIG. 12(*a*) to minimize the temperature difference between the end portions and the central portion of printing paper S.

In the printer, if the width of printing paper on which the toner image is fused is width L between the width of the minimum printing paper and the width of the maximum printing paper, the resultant heat distribution in the axis direction of fusing roller 31 after composing the heat application from heater members 34, 35 is set such that the end portions in the axis direction of fusing roller 31 is almost equal to or slightly higher than the central portion in the axis direction of fusing roller 31. As such, the temperature difference between the end portions and the central portion of printing paper S can be equal to that of the printing paper S having minimum width, as shown in FIG. 12(*a*).

Further, in the printer, the resultant heat distribution in the axis direction of fusing roller 31 after composing the heat application from heater member 34, 35 is set such that the end portions in the axis direction of fusing roller 31 becomes higher in the heat distribution than the central portion in the axis direction of fusing roller 31 as shown in FIG. 11(*c*) in a case where the width of printing paper S on which the toner image is fused equals to the width of the maximum printing paper, thereby enabling a heat supply to the end portions of printing paper S and a compensation of the heat amount discharged to roller supporting members such as a metal chassis provided on the end portions in the axis direction of fusing roller 31 as well. As such, the temperature difference between the end portions and the central portion of printing paper S can be adjusted almost equal to the temperature difference that occurs in printing paper S having the width of the minimum printing paper.

Still further, in the printer, in a case where width of printing paper S on which the toner image is fused resides between the width of the minimum printing paper and width L residing between the width of the minimum printing paper and the width of the maximum printing paper and in a case where the width of printing paper S on which the toner image is fused resides between width L residing between width of the minimum printing paper and the width of the maximum printing paper and the width of the maximum printing paper, the temperature difference between the end portions and the central portion of printing paper S can almost be equalized to the temperature difference that occurs in printing paper S having the width of the minimum printing paper.

As stated above, the printer exemplified as the first embodiment according to the present invention is capable of variably setting the divisional rate for dividing the heat amount to be charged per unit time to heater members 34, 35 having different heat distributions in accordance with the width and/or thickness of printing paper S on which the toner image is fused and/or the print mode. As such, the temperature difference between the end portions and the central portion of printing paper S caused by the difference of the width and/or thickness of printing paper S and/or the conveying speed of the printing paper can be minimized, resulting in avoiding the fusing nonuniformity.

Explained next is a printer exemplified as a second embodiment.

The printer as the second embodiment has a temperature sensor for detecting the temperature of the end portion in the axis direction of the fusing roller. Therefore, in the explanation of the second embodiment, the same numerals and/or symbols are assigned to the elements similar to those in the first embodiment and therefore omit the detailed explanations thereof.

Figure 13:
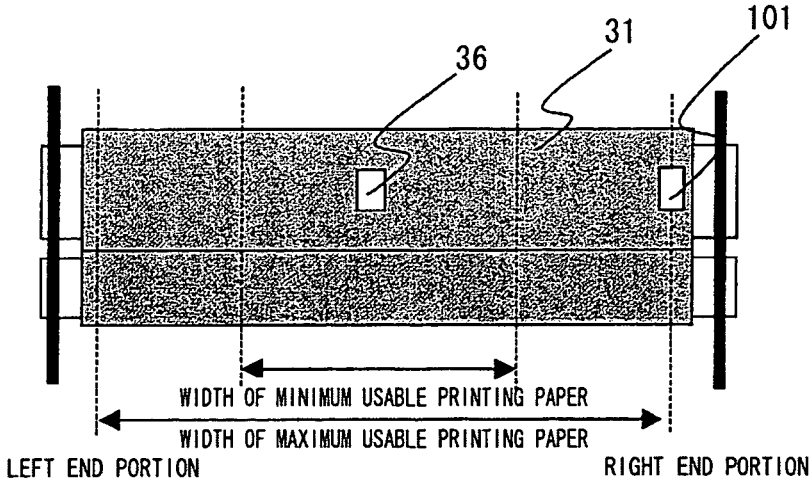
FIG. 13 is a cross sectional view illustrating a structure of the fusing unit of the printer as the second embodiment of the present invention when viewing from upstream in the conveying direction of the printing papers.

Fusing unit 21 of the printer according to the second embodiment is provided with end portion temperature sensor 101 on a surface of the end portion in the axis direction of fusing roller 31 in a surface contacting manner as shown in FIG. 13. Fusing unit 21 detects the surface temperature of the end portion in the axis direction of fusing roller 31 by using end portion temperature sensor 101.

Figure 14:
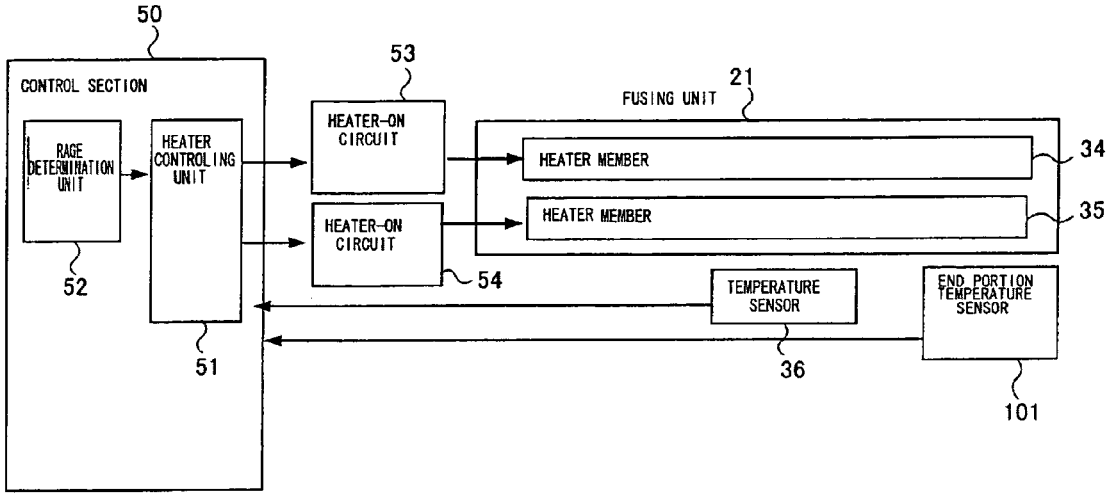
FIG. 14 is a block diagram illustrating a structure of a control system of the printer as the second embodiment of the present invention.

The above stated fusing unit 21 heat controls heater members 34, 35 according to the control system as shown in FIG. 14. That is, apart from such a system according to the first embodiment that the information indicative of the print mode or the size or thickness of printing paper S input through interface circuit 55 of heater members 34, 35 is input into the fusing unit, control section 50 has a system in which the detected temperature information indicative of the surface temperature of the central portion in the axis direction of fusing roller 31 detected by temperature sensor 36 and the detected temperature information indicative of the surface temperature of the end portion in the axis direction of fusing roller 31 detected by end portion temperature sensor 101 are input into the fusing unit to find the temperature difference between those two surface temperatures and supplies the temperature difference information indicative of such temperature difference to rate determination unit 52. After rate determination unit 52 determines the divisional rate as to heater members 34, 35, control section 50 generates the current signals with regard to heater members 34, 35 on the basis of the divisional rate information indicative of this divisional rate. The current signals output from heater controlling section 51 to heater members 34, 35 are respectively input into heater-on circuits 53, 54 which place heater members 34, 35 in on-state. Heater-on circuits 53, 54 energize heater members 34, 35 with driving currents, respectively, if the individual input current signal represents on-period, thereby heat controlling heater members 34, 35 independently.

The printer having the above stated fusing unit 21 performs a determination operation of the divisional rate for each of heater members 34, 35 by means of rate determination unit 52 under the control of control section 50.

Figure 15:
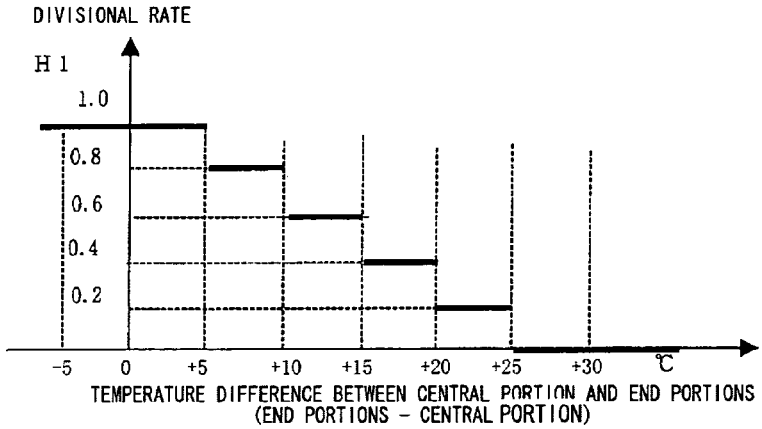
FIG. 15 is a graph showing a relationship between the temperature difference between a surface temperature of end portions and a surface temperature of the central portion in the axis direction of the fusing roller and the divisional rate of the printer as the second embodiment of the present invention.

As exemplified in FIG. 15, rate determination unit 52 preliminarily sets a relational expression in which the divisional rate in terms of the temperature difference between the surface temperature of the end portion in the axis direction of fusing roller 31 detected by end portion temperature sensor 101 and the surface temperature of the central portion in the axis direction of fusing roller detected by temperature sensor 36 can be uniquely defined and then determines the divisional rate for each of heater members 34, 35 on the basis of the input temperature difference information.

FIG. 15 exemplifies a setting in which the divisional rate of heater member 34 is gradually decreased as the input temperature difference between the end portion and the central portion becomes large and the resultant heat distribution in the axis direction of fusing roller 31 after composing the heat application from heater members 34, 35 gradually becomes lower as going closer to the end portion in the axis direction of fusing roller 31. In the printer with such a setting, an amount of the temperature rise of the end portion in the axis direction of fusing roller 31 varies in accordance with the width or thickness or the printing paper or the conveying speed of the printing paper in cases where printing paper S having a narrow width is used, where printing paper S having large thickness is used and where the printing is performed with a high conveying speed of the printing paper. According to the variation in the amount of the temperature rise, such a proper divisional rate is selected that the temperature rise of the end portion in the axis direction of fusing roller 31 can be controlled.

In the printer according to the present embodiment, the divisional rate is decreased gradually by 0.2 upon every 5 degree-increase of the temperature difference; however such decreasing of the divisional rate can be freely set according to the heat conducting property and heat discharging property of fusing unit 21. Also, if the divisional rate is not varied step by step but is varied continuously by setting the varying step small, the same advantageous result still can be produced.

As stated above, the printer exemplified as the second embodiment of the present invention detects the temperature difference between the central portion and the end portion in the axis direction of fusing roller 31 with respect to the width or thickness of printing paper S on which the toner image is fused or the conveying speed of the printing paper and can variably set the divisional rate for dividing the heat amount to be charged per unit time to heater members 34, 35 having different heat distributions on the basis of thus detected temperature difference. Therefore, the temperature difference between the end portion and the central portion of printing paper S caused by the differences of the width or thickness of printing paper S and/or the conveying speed of the printing paper can be minimized, resulting in the avoidance of the fusing nonuniformity.

Since the printer detects the difference of the width or thickness of printing paper S or the conveying speed of the printing paper on the basis of the temperature difference between the central portion and the end portion in the axis direction of fusing roller 31, the heat distribution appropriate to printing paper S to be used for printing can be selected even in a case where the setting of the width or thickness of printing paper S or the conveying speed of the printing paper designated by the user differs from printing paper S actually stacked in the printer, thereby being capable of avoiding the fusing nonuniformity caused by the user's erroneous designation.

Figure 16:
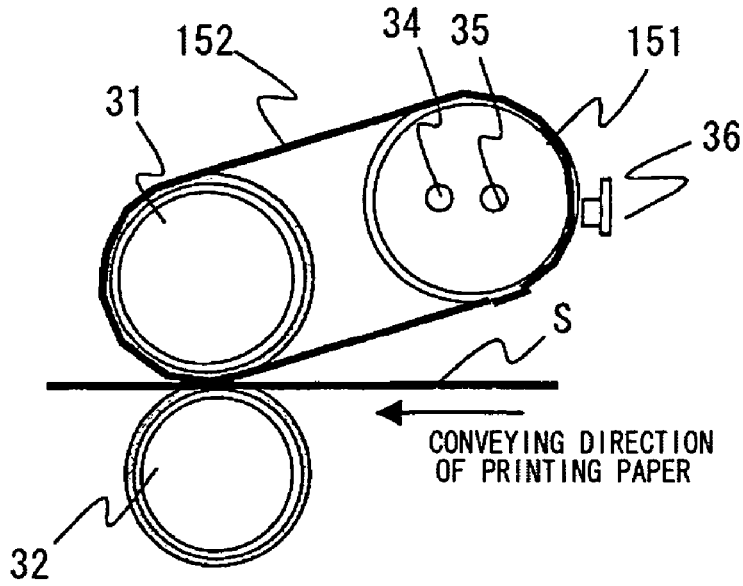
FIG. 16(*a*) is a lateral cross sectional view illustrating another structure of the fusing unit of the printer as the embodiment of the present invention, in which a structure both of two heater members are placed within a heating roller is illustrated.
Figure 16:
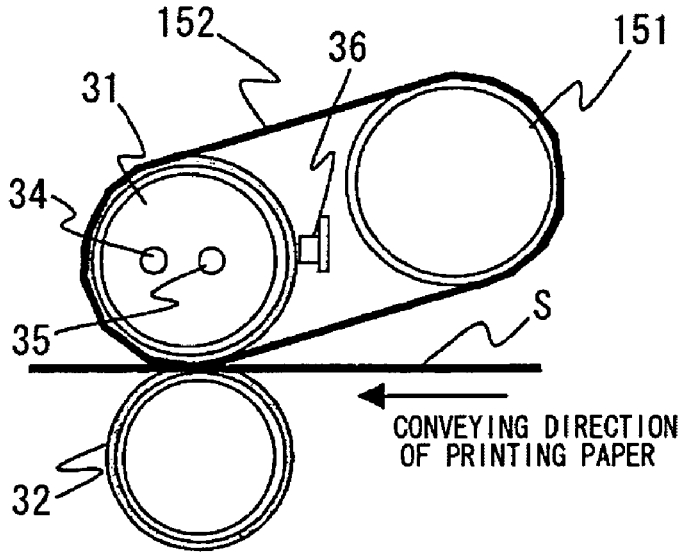
Figure 16:
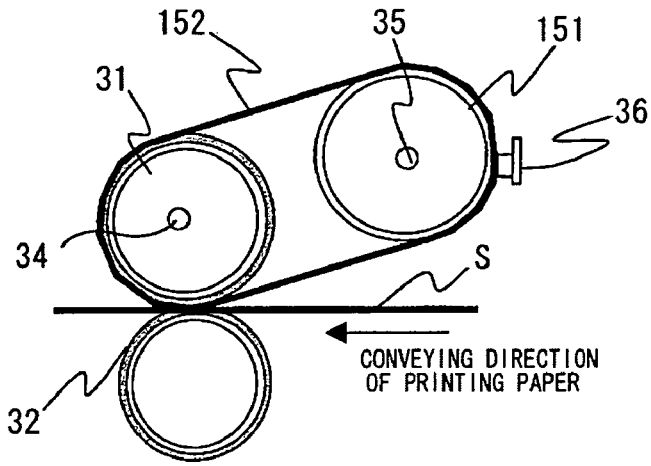

It is appreciated that the present invention is not limited only to the above stated embodiments. For example, the above embodiment exemplified a structure of fusing unit 21 using fusing roller 31 and pressurizing roller 32 in FIG. 2(*a*). However, the present invention is also applicable to the fusing unit other than the ones as stated above. For example, the fusing unit may have such structure that fusing roller 31 and heating roller 151 of a metal roller disposed apart from fusing roller 31 by a predetermined distance are provided with the predetermined belt member 152 so as to be stretched between the rollers, as shown in FIGS. 16(*a*), 16(*b*) and 16(*c*). Here, the fusing unit may have heater members 34, 35 placed within heating roller 151 shown in FIG. 16(*a*), or may have both of heater members 34, 35 placed within fusing roller 31 as shown in FIG. 16(*b*) and further may have heater members 34, 35 which are individually placed within each of fusing roller 31 and heating roller 151 as shown in FIG. 16(*c*).

In the above stated first embodiment, the information indicative of print mode or the size or the thickness of printing paper S to be used was explained as being transferred from a host apparatus connected to the printer through interface circuit 55. However, in the present invention, the information can be input through an operation panel as a condition input unit, not shown, the operation panel disposed in the image recording apparatus. Also, in the present invention, a sensor as the detection unit for detecting the size and thickness of the printing paper may be disposed in the image recording apparatus as the condition input unit in order to use a value detected by the sensor.

In the above stated embodiment, the present invention was so explained that two heater members 34, 35 are disposed in the present invention; however, a plural heater members, i.e., more than three, having different heat distributions each other may also be disposed in the present invention.

Further in the above stated embodiment, the present invention was applied to the printer as the image recording apparatus; however, the present invention is readily applicable to any devices in the use of image printing involving fusing operation, such as an electrophotographic printer for heat fusing a toner, an ink jet printer for dry fusing an ink, facsimile machine, copying machine, any other apparatus having those functions in combination and the like.

The present invention as stated above is capable of being modified as required without departing from the spirit of the present invention.

As described above, it is obvious that this invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image recording apparatus having a fusing unit for heat fusing a toner image onto a predetermined print medium by heating and pressurizing the print medium, the image recording apparatus comprising:

at least first and second heater members having different heat distributions, said heater members disposed in said fusing unit in order to apply heat onto said print medium;

a temperature detecting unit for detecting a temperature of an area where said print medium passes through said fusing unit;

a heat controlling unit for controlling said fusing unit at a prescribed temperature by a heat controlling of said heater members, using independent respective control signals, on the basis of the temperature detected by said temperature detecting unit;

a rate determination unit for determining a divisional rate of heat to be supplied per unit time by said fusing unit by means of said heater members; and a condition input unit for inputting a fusing condition of said fusing unit;

wherein said rate determination unit determines the divisional rate of the heat to be supplied per unit time by said fusing unit by means of said heater members on a basis of the fusing condition inputted by said condition input unit;

wherein said heat controlling unit controls heating of said heater members, using independent respective control signals, on a basis of the divisional rate determined by said rate determination unit; and wherein the image recording apparatus and first and second heater members are configured so that, when the first and second heater members are on, a minimum of a heat distribution at a central portion of the first heater member is lower than maximums of heat distributions at end portions of the first heater member and higher than maximums of heat distributions at end portions of the second heater member, and a maximum of a heat distribution at a central portion of the second heater member is lower than maximums of heat distributions at end portions of the first heater member and higher than maximums of heat distributions at end portions of the second heater member, wherein the central portions of the first and second heater members each correspond to a region of a minimum width of a usable printing medium, and each of the end portions of the first and second heater members corresponds to a region between an end of the region of a minimum width of a usable printing medium and an end of a region of a maximum width of the usable printing medium.

2. The image recording apparatus according to claim 1, wherein said fusing unit sandwiches said print medium between a first roller member and a second roller member disposed opposing the first roller member, thereby heating and pressurizing the print medium, and wherein said heater members are placed within said first roller member.

3. The image recording apparatus according to claim 1, wherein said fusing condition is a width of said print medium.

4. The image recording apparatus according to claim 1, wherein said fusing condition is a conveying speed of said print medium.

5. The image recording apparatus according to claim 1, wherein said fusing condition is a thickness of said print medium.

6. The image recording apparatus according to claim 1, wherein said condition input unit is configured to input information indicative of said fusing condition, the information being transferred from an external device connected to an outside of the image recording apparatus to the condition input unit.

7. The image recording apparatus according to claim 1, wherein said condition input unit is an operation panel disposed in the image recording apparatus in order to input information indicative of said fusing condition.

8. The image recording apparatus according to claim 1, wherein said condition input unit is a detecting unit for detecting said fusing condition.

9. The image recording apparatus according to claim 1, further comprising heater-on-circuits operatively respectively connected with said heater members, wherein the heat controlling unit is configured to generate conductive signals based on the divisional rate and to input respective conductive signals to the respective heater-on circuits to activate respective heating members with driving current from the respective heater-on circuits based on the respective conductive signals inputted to the respective heater-on circuits.

10. The image recording apparatus according to claim 1, wherein the heat controlling unit is configured to determine a needed heat amount per unit time based upon the temperature detected, to divide the needed heat amount per unit time based upon the divisional rate, and to control the first and second heaters based upon a division of the needed heat amount per unit time based upon the divisional rate.

11. The image recording apparatus according to claim 1, wherein the heat distribution at the central portion of said first heater member is substantially equal to the heat distribution at the central portion of said second heater member.

12. The image recording apparatus according to claim 11, further comprising heater-on-circuits operatively respectively connected with said heater members, wherein the heat controlling unit is configured to generate conductive signals based on the divisional rate and to input respective conductive signals to the respective heater-on circuits to activate respective heating members with driving current from the respective heater-on circuits based on the respective conductive signals inputted to the respective heater-on circuits.

13. The image recording apparatus according to claim 12, wherein the heat controlling unit is configured to determine a needed heat amount per unit time based upon the temperature detected, to divide the needed heat amount per unit time based upon the divisional rate, and to control the first and second heaters based upon a division of the needed heat amount per unit time by the predetermined divisional rate.

14. The image recording apparatus according to claim 11, wherein the heat controlling unit is configured to determine a needed heat amount per unit time based upon the temperature detected, to divide the needed heat amount per unit time based upon the divisional rate, and to control the first and second heaters based upon a division of the needed heat amount per unit time based upon the divisional rate.

15. An image recording apparatus having a fusing unit for heat fusing a toner image onto a predetermined print medium by heating and pressurizing the print medium, the image recording apparatus comprising:

heater members having different heat distributions, said heater members being disposed in said fusing unit in order to apply heat onto said print medium;

a temperature detecting unit for detecting a temperature of an area where said print medium passes through said fusing unit;

a heat controlling unit for controlling said fusing unit at a prescribed temperature by a heat controlling of said heater members, using independent respective control signals, on the basis of the temperature detected by said temperature detecting unit;

a rate determination unit for determining a divisional rate of heat to be supplied per unit time by said fusing unit by means of said heater members; and a condition input unit for inputting a fusing condition of said fusing unit; wherein said rate determination unit determines the divisional rate of the heat to be supplied per unit time by said fusing unit by means of said heater members on a basis of the fusing condition inputted by said condition input unit;

wherein said heat controlling unit controls heating of said heater members, using independent respective control signals, on a basis of the divisional rate determined by said rate determination unit; and wherein the heat controlling unit is configured to determine a needed heat amount per unit time based upon the temperature detected, to divide the needed heat amount per unit time based upon the divisional rate, and to control the first and second heaters based upon a division of the needed heat amount per unit time based upon the divisional rate.

16. The image recording apparatus according to claim 15, further comprising heater-on-circuits operatively respectively connected with said heater members, wherein the heat controlling unit is configured to generate conductive signals based on the divisional rate and to input respective conductive signals to the respective heater-on circuits to activate respective heating members with driving current from the respective heater-on circuits based on the respective conductive signals inputted to the respective heater-on circuits.

* * * * *

UNITED STATES PATENT AND TRADEMARK OFFICE

CERTIFICATE OF CORRECTION

PATENT NO. : 7,664,416 B2
APPLICATION NO. : 11/370621
DATED : February 16, 2010
INVENTOR(S) : Tomonori Watabe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 464 days.

Signed and Sealed this

Thirtieth Day of November, 2010

David J. Kappos

David J. Kappos
*Director of the United States Patent and Trademark Office*